US012753931B2

(12) United States Patent
Puoti et al.

(10) Patent No.: US 12,753,931 B2
(45) Date of Patent: Oct. 6, 2026

(54) EXTRACTION DEVICE WITH FILTER CARRIER AND FILTER

(71) Applicant: ELECTROLUX APPLIANCES AKTIEBOLAG, Stockholm (SE)

(72) Inventors: Eduardo Puoti, Forli (IT); Lokesh Patil, Forli (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 567 days.

(21) Appl. No.: 18/019,096

(22) PCT Filed: Dec. 7, 2020

(86) PCT No.: PCT/EP2020/084896
§ 371 (c)(1),
(2) Date: Jan. 31, 2023

(87) PCT Pub. No.: WO2022/028725
PCT Pub. Date: Feb. 10, 2022

(65) Prior Publication Data

US 2023/0296263 A1 Sep. 21, 2023

(30) Foreign Application Priority Data

Aug. 5, 2020 (EP) ..... 20189683

(51) Int. Cl.
*F24C 15/20* (2006.01)
*F24C 15/14* (2006.01)

(52) U.S. Cl.
CPC ..... *F24C 15/2042* (2013.01); *F24C 15/14* (2013.01); *F24C 15/2035* (2013.01)

(58) Field of Classification Search
CPC ... F24C 15/2042; F24C 15/14; F24C 15/2035
(Continued)

(56) References Cited

U.S. PATENT DOCUMENTS 6,344,074 B1 2/2002 Ward et al.
6,455,818 B1 9/2002 Arntz et al.
(Continued)

FOREIGN PATENT DOCUMENTS

CN 1380957 11/2002
CN 103688111 3/2014
(Continued)

OTHER PUBLICATIONS

Machine Translation of CN 208839250 (Year: 2019).*
(Continued)

*Primary Examiner* — Allen R. B. Schult
*Assistant Examiner* — Amy E Carter
(74) *Attorney, Agent, or Firm* — Chrisman Gallo Tochtrop LLC

(57) ABSTRACT

The present invention relates to an extraction device (14) for removing air from an area above a cooking hob (12). The extraction device (14) comprises an inlet opening (38) for an intake of the air into an interior of the extraction device (14), an outlet opening (30) for exhausting air, at least one filter element (52; 52*a*, 52*b*), and at least one filter carrier (50) for accommodating the at least one filter element (52; 52*a*, 52*b*). The filter element (52; 52*a*, 52*b*) and the filter carrier (50) are arranged in airflow direction between the inlet opening (38) and the outlet opening (30). According to the invention, the filter element (52; 52*a*, 52*b*) is a separate unit, which is separable and removable from the filter carrier (50). The present invention further relates to a combination appliance (10) and to a method for providing a filter carrier (50) of an extraction device (14) with a filter element (52*a*, 52*b*).

16 Claims, 11 Drawing Sheets

(58) Field of Classification Search
USPC ..... 126/299 D
See application file for complete search history.

(56) References Cited

U.S. PATENT DOCUMENTS

| | | | | |
|---|---|---|---|---|
| 6,626,972 | B2 * | 9/2003 | Chiang | B01D 46/0005 55/482 |
| 6,716,267 | B2 * | 4/2004 | Lawlor, Sr. | B01D 46/001 55/497 |
| 7,637,127 | B2 | 12/2009 | Mills et al. | |
| 7,687,748 | B2 | 3/2010 | Gagas | |
| 8,872,077 | B2 | 10/2014 | Gagas et al. | |
| 10,788,222 | B2 | 9/2020 | Froelicher et al. | |
| 10,900,665 | B2 | 1/2021 | Flesch et al. | |
| 11,033,847 | B2 | 6/2021 | Adam et al. | |
| 11,193,675 | B2 | 12/2021 | Neunhauserer et al. | |
| 11,592,188 | B2 | 2/2023 | Bruckbauer | |
| 11,732,901 | B2 | 8/2023 | Kim et al. | |
| 11,739,943 | B2 | 8/2023 | McEvoy | |
| 11,885,505 | B2 | 1/2024 | Chartrel et al. | |
| 12,111,059 | B2 | 10/2024 | Flesch et al. | |
| 2006/0278216 | A1 * | 12/2006 | Gagas | F24C 15/2028 126/299 D |
| 2007/0023420 | A1 | 2/2007 | Gagas | |
| 2010/0163549 | A1 | 7/2010 | Gagas et al. | |
| 2012/0204855 | A1 | 8/2012 | Huber | |
| 2014/0366496 | A1 | 12/2014 | Salpietra | |
| 2018/0207312 | A1 | 7/2018 | Chiang | |
| 2020/0094180 | A1 | 3/2020 | Adam et al. | |
| 2021/0310666 | A1 | 10/2021 | Bruckbauer et al. | |
| 2022/0178552 | A1 * | 6/2022 | Flesch | F24C 15/2035 |
| 2023/0184442 | A1 | 6/2023 | Bruckbauer | |
| 2023/0213209 | A1 | 7/2023 | Leikam et al. | |
| 2023/0280044 | A1 | 9/2023 | Caso et al. | |
| 2023/0296263 | A1 | 9/2023 | Puoti et al. | |
| 2024/0085031 | A1 | 3/2024 | Benold et al. | |
| 2024/0102667 | A1 | 3/2024 | Bariviera et al. | |
| 2024/0328631 | A1 | 10/2024 | King et al. | |

FOREIGN PATENT DOCUMENTS

| | | | | |
|---|---|---|---|---|
| CN | 105698234 | | 6/2016 | |
| CN | 106659959 | | 5/2017 | |
| CN | 206919092 | | 1/2018 | |
| CN | 208839250 | | 5/2019 | |
| CN | 208839250 | U * | 5/2019 | F24C 15/2035 |
| CN | 110160102 | | 8/2019 | |
| CN | 110578943 | | 12/2019 | |
| DE | 29709350 | | 10/1997 | |
| DE | 202009008286 | | 9/2009 | |
| DE | 202016003254 | | 6/2016 | |
| DE | 202016104283 | | 8/2016 | |
| DE | 102018212329 | | 1/2020 | |
| DE | 102018213743 | | 2/2020 | |
| DE | 102018213743 | A1 * | 2/2020 | F24C 15/2042 |
| EP | 0034732 | | 9/1981 | |
| EP | 1575693 | | 9/2005 | |
| EP | 2336649 | | 6/2011 | |
| EP | 2950005 | | 12/2015 | |
| EP | 3133349 | | 2/2017 | |
| EP | 3287701 | | 2/2018 | |
| EP | 3287701 | A1 * | 2/2018 | F24C 15/2042 |
| EP | 3290813 | | 3/2018 | |
| EP | 3290813 | A1 * | 3/2018 | F24C 15/2042 |
| JP | S4417592 | | 7/1969 | |
| KR | 101586379 | | 1/2016 | |
| WO | 2017029138 | | 2/2017 | |
| WO | 2017089925 | | 6/2017 | |
| WO | 2019081271 | | 5/2019 | |
| WO | WO-2019081271 | A1 * | 5/2019 | F24C 15/2035 |
| WO | 2019166249 | | 9/2019 | |
| WO | 2019197055 | | 10/2019 | |

OTHER PUBLICATIONS

Machine Translation of DE 102018213743 (Year: 2020).*
EP-3287701 A1 with Machine Translation (Year: 2018).*
EP-3290813 A1 with Machine Translation (Year: 2018).*
European Communication for application No. 20189683.4, dated Nov. 24, 2024, 19 pages.
International Search Report and Written Opinion for PCT/EP2020/084896, dated Jun. 21, 2021, 24 pages.
Brazilian Office action for application No. BR112023001346-1, dated Jul. 6, 2025, 5 pages.

* cited by examiner

EXTRACTION DEVICE WITH FILTER CARRIER AND FILTER

During the performance of cooking activities under use of a cooking hob, kitchen vapours are generated, which are distributed over the cooking area. In order to avoid these kitchen vapours to be spread throughout the entire kitchen space, an arrangement of an extraction device, particularly an extractor hood, is common. Said extraction device is operated in parallel to the cooking hob, thereby sucking in those kitchen vapours in order to filter out particles and tiny droplets from the vapours and/or to blow the vapours to the outside of the building. While it has been common to arrange such an extractor hood above the cooking area, in recent years downdraft extraction devices have been finding a growing market. Such kind of extraction device is usually arranged below a worktop of the related cooking hob and it comprises at least one fan for sucking air from the cooking area through an opening or recess arranged in the worktop. The extraction device further comprises a filter assembly arranged in or downstream the opening or recess for performing the filtering function. Said filter assembly has usually a complex structure, which is hard to be handled during maintenance works and not completely cleanable, particularly due to badly accessible corner areas.

It is an object of the present invention to provide an extraction device, a combination appliance and a method for providing a filter carrier of an extraction device with a filter element, which allow or support a simplified handling of a filtering system of this extraction device, notably during maintenance works, and which enable a complete filter cleaning, in order to avoid output losses throughout the entire lifetime of the extraction device.

An extraction device for removing air from an area above a cooking hob comprises an inlet opening for an intake of the air into an interior of the extraction device, an outlet opening for exhausting air at least one filter element and at least one filter carrier for accommodating the at least one filter element. The filter element and the filter carrier are arranged in airflow direction between the inlet opening and the outlet opening. The filter element according to the present invention is a separate unit, which is separable and removable from the filter carrier. Such removability notably facilitates a cleaning and/or replacement of the filter element in order to fully maintain at any time a sufficient filtering function performed by the extraction device.

The filter element is configured to filter out particles, which may be solid particles and/or droplets, from the air passing therethrough. The air particularly comprises cooking vapours sucked in from the area above the cooking hob. After said filtering the air leaves the extraction device through the outlet opening and particularly mixes with room air or ambient air. A preferred embodiment of the filter element is a flat filter element, specifically including a planar filter area.

Preferably, in order to further facilitate the handling during maintenance works, provision is made that not only the filter element is separable and removable from the filter carrier, but also the filter carrier itself is removably arranged inside the extraction device. That way, the extraction device is provided for very simple maintenance works in such a way that initially the filter carrier is removable from the extraction device, specifically via the inlet opening of the extraction device, and thereafter the filter element is detachable from the filter carrier, so that both filter carrier and filter element may separately be cleanable.

In particular, the extraction device is an extraction hood, which may be a downdraft extraction hood. The extraction device is preferably configured to form a combination appliance in combination with the cooking hob. To this end, the extraction device may be arranged beneath, in particular directly beneath, the cooking hob.

In order to drive the airflow through the extraction device, at least one fan is preferably arranged inside of the extraction device, specifically between the inlet opening and the outlet opening. The air approaching said fan may be channeled through a fan opening of the fan, notably of a fan housing.

Preferably, the filter element, in particular said flat filter element, comprises a filter frame or filter support surrounding and/or supporting a filter area or a filter section. In that, the filter element may include a frame part and a filter part, wherein the filter part is configured to perform the filtering function, while the frame part is configured to provide a support function, in particular to stretch the filter part, and in this respect to support the filter part in performing the filtering function.

A favourable embodiment of the present invention provides for a filter carrier, which comprises a filter seat for taking up or accommodating the filter element. Said filter seat provides for a definite assignment and positioning of the filter element to and within the filter carrier. The filter element is preferably accommodated or accommodatable in a clamped position within the filter seat. That way, a mounting free of play is realized, which particularly avoids noise caused by vibration. The clamping is favourably spring-loaded.

For securely holding the filter element in place, the filter carrier particularly comprises a retainer element configured to retain the filter element in the filter seat. At least one of the following characteristics may apply to the retainer element:

- the retainer element is elastically arranged at the filter carrier,
- the retainer element is made of a flexible material,
- the retainer element forms a snapping or clamping element,
- the retainer element rests on, preferably is pressed on, a section of the filter frame.

In particular, the retainer element rests on an upper section of the filter element.

One particularly preferred embodiment of the present invention provides at least one spring element that is supported against an inner surface of the filter carrier and acts on the filter element, particularly on the filter frame. More specifically, the spring element presses the filter frame against the retainer element. The spring element may be made of any suitable material, but preferably a metal spring is used.

One favourable clamping mechanism for the filter element is established by the retainer element and the spring element acting on opposite sides of the filter frame. Said opposite sides are preferably defined by an upper part or upper section and a lower part or lower section of the filter frame. A particularly appropriate filter frame design is of rectangular shape.

The filter element may comprise a first filter frame part or first filter frame section, which is assigned to the spring element, and a second filter frame part or second filter frame section, which is assigned to the retainer element and which is opposite to the first filter frame part or first filter frame section. In the case of a rectangular shape, said first and second filter frame parts or sections may be frame parts that are arranged in parallel on opposite sides of the rectangle. In such kind of embodiment, at least one of the first and second filter frame parts or sections comprises a recess or a cut-out for receiving a portion of the respectively assigned retainer element or spring element. Said portion may be any protrusion engaging in the cut-out or recess.

More specifically, in a stressed state of the spring element the filter frame is released or releasable from the retainer element and the spring element is at least partially unloaded when the filter frame is in its assembled position. That way, an assembly or a disassembly may be easily performable by stressing the spring element, notably by pressing with a section of the filter element against the spring element, and thereafter by bringing the filter element, particularly the filter frame, in engagement with the retainer element, or, respectively, releasing the filter element, particularly the filter frame, from engagement with the retainer element.

According to one embodiment, the filter carrier comprises a carrier frame part, preferably an upper carrier frame part, which is at least partially detachable from the filter carrier. Partial detachability may mean that the carrier frame part is completely removable from the filter carrier. Alternatively, the carrier frame part may be rotatably mounted at an edge of the filter carrier. In order to fasten the carrier frame part at the remaining part or parts of the filter carrier, at least one locking device or locking feature may be comprised on or at at least one of said involved components. With such locking device or locking feature not only a connection between the carrier frame part and the remaining part or parts of the filter carrier is realized, moreover, also a fixing of the filter element inside or at the filter carrier may be established.

The retainer element may be a part or portion of the carrier frame part. Alternatively, the retainer element may be formed by the carrier frame part, i. e. the carrier frame part itself may be the retainer element. A simple and effective filter element placement is realized in that the carrier frame part is attachable or closable after putting the at least one filter element in place.

Another preferred embodiment of the present invention is characterized by a filter carrier, which may be a filter seat of the filter carrier, including guiding means for a guided insertion of the filter element. The guiding means may be a bearing surface or a lay-on edge, also a guiding slot may be considered. In addition or as an alternative, a support section for a pivoted take-up of the filter element may be included. Said pivoted take-up is preferably addressed to a filter frame part or filter frame section, favourably to a lower filter frame part or lower filter frame section. More specifically, the support section may be a cavity or the like for receiving said filter frame part or section, allowing a pivoting of the filter element around an axis of rotation in this area, so that an opposite filter frame section can be swung into and out of its installation position. Such arrangement provides for a particularly simple and guided installation process.

Preferably, the extraction device, notably its filter unit, includes at least two filter elements, namely at least a first filter element and a second filter element, which may be first and second flat filter elements. Said at least first and second filter elements are arranged in the filter carrier, which may be arranged in parallel to each other. Preferably, however, the two filter elements are arranged in inclined positioning, more preferably in a V-shaped alignment, so that the two, particularly rectangular, filter elements confine an angle, favourably an acute angle, notably in the cross-section of the arrangement of the two filter elements. More specifically, said V-shape is provided by two flat filter elements that are arranged by forming an angle between 5 and 85 degrees, preferably between 20 and 70 degrees, more preferably between 30 and 60 degrees. There is no preference for a symmetrical arrangement of the filter arrangement, i. e. the two flat filters don't have to be identical. Rather, a design of these two filter elements may be characterized by different lengths and/or widths. Such unsymmetrical arrangement may be favourable with respect to a standardized and non-reversed reassembly. Naturally, such symmetrical arrangement is one specific solution.

The object is also achieved by a combination appliance, which includes a cooking hob and an extraction device according to anyone of the afore-described embodiments.

The cooking hob may include at least one cover plate or worktop, which has an opening or a recess formed therein, particularly in or close to a central region thereof. The extraction device is particularly arranged below the cover plate or worktop and may comprise at least one fan for sucking air, in particular kitchen vapour, from the area above the cooking hob through the opening or recess of the cover plate or worktop.

The cooking hob may be of any type including electric or gas cooking hobs. In particular, an induction cooking hob is a part of the combination appliance. The cooking hob may further be an autarkic cooking appliance, particularly integrated in a countertop of a kitchen furniture, or it may be part of a stove.

A top surface of the cover plate or worktop, which is accessible to a user of the combination appliance, may be used for putting cookware thereon, specifically in order to perform a cooking process. To this end, the cooking hob preferably comprises at least one heating element defining a cooking zone on the cover plate or worktop. The cover plate or worktop may be of any suitable design or material, but favourably it is made out of glass ceramics.

Finally, the object is further achieved by a method for providing a filter carrier of an extraction device with a filter element. According to the present invention, the filter element is a flat filter element that is inserted in the filter carrier with a bottom edge thereof, and, thereafter, the filter element is pivoted into its mounting position in the filter carrier. The mounting position is preferably an inclined position.

One specific embodiment of the method according to the invention is characterized in that the filter element is

- inserted in a lower section of a filter seat,
- pressed against the force of a spring arranged in the lower section of the filter seat,
- pivoted into its mounting position, and
- supported against a retainer element by at least partially releasing the spring tension.

The above-mentioned installation process steps are recited in consecutive order as they are executed.

Novel and inventive features of the present invention are set forth in the appended claims.

The present invention will be described in further detail with reference to the drawings, in which FIG. 1 is a perspective view of a combination appliance comprising a cooking hob and a downdraft extraction device installed in a kitchen cabinet;

Figure 11:
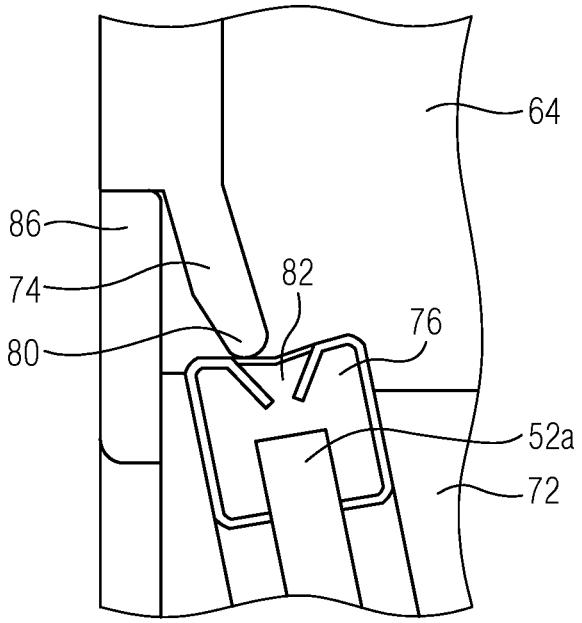
FIG. 11 is an enlarged detail view of detail XI indicated in FIG. 10, but in lateral viewing direction.
Figure 12:
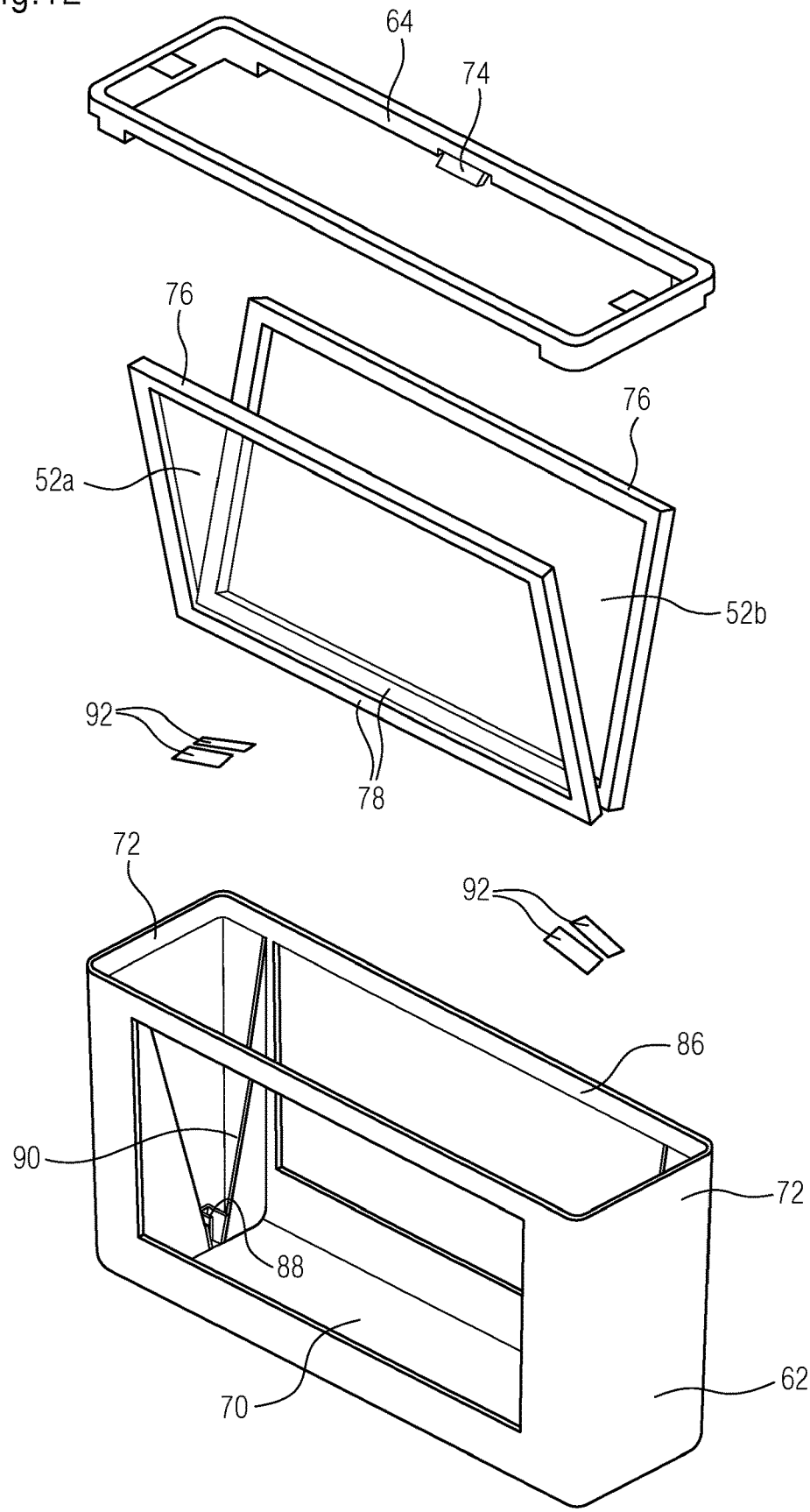
FIG. 12 is an exploded view of the filter assembly according to the second example, shown in FIG. 10.
Figure 14A:
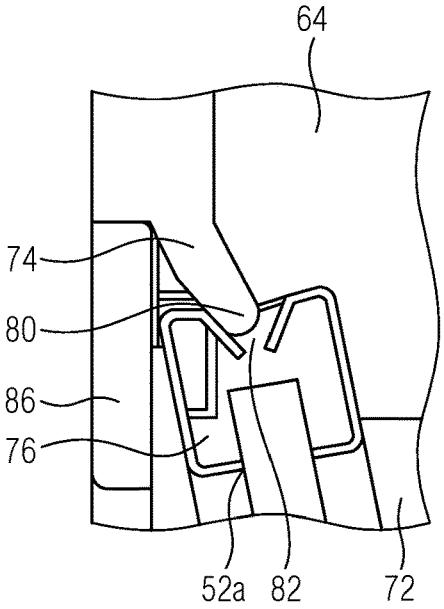
Figure 14B:
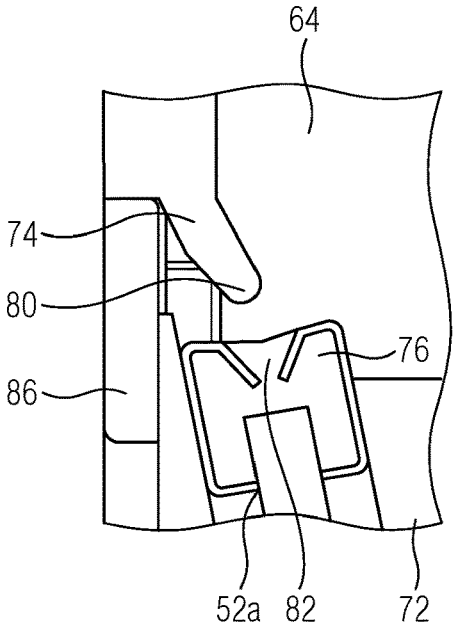
Figure 15A:
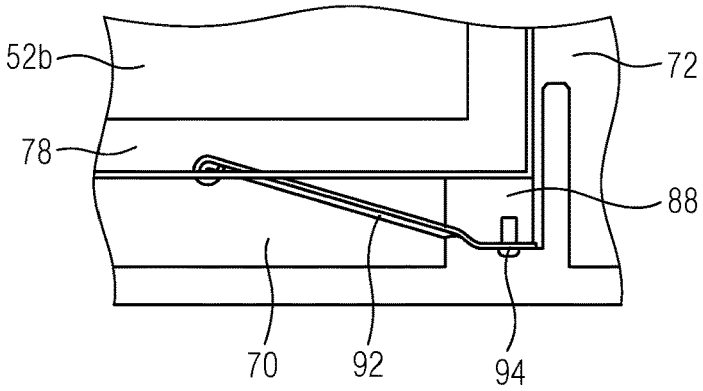
Figure 15B:
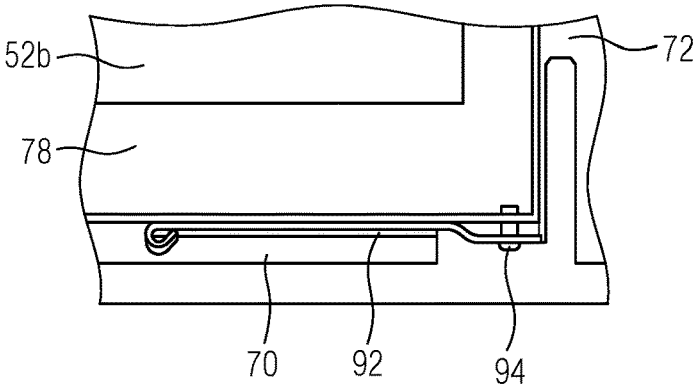

FIGS. 14*a*,14*b* illustrate the arrangement according to FIG. 11, but in two different situations of a mounting process for the filter element of the filter assembly;

FIGS. 15*a*, 15*b* illustrate detail views of a bottom part of the filter assembly according to FIG. 12, also in two different situations of a mounting process for the filter element of the filter assembly, in line with FIGS. 14*a*, 14*b;*

Figure 9:
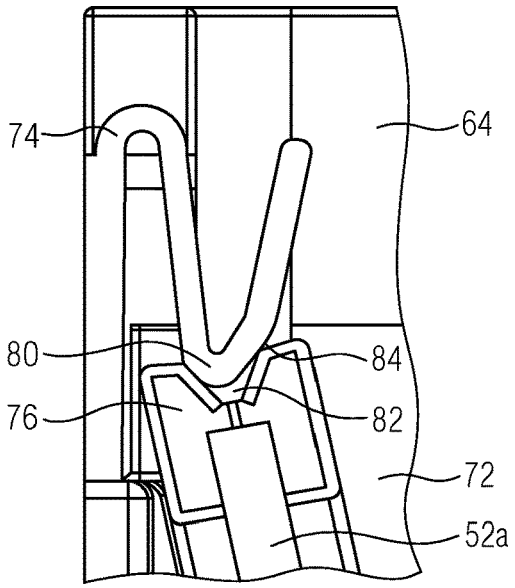
FIG. 9 is an enlarged detail view of detail IX indicated in FIG. 8, but in lateral viewing direction.
Figure 16:
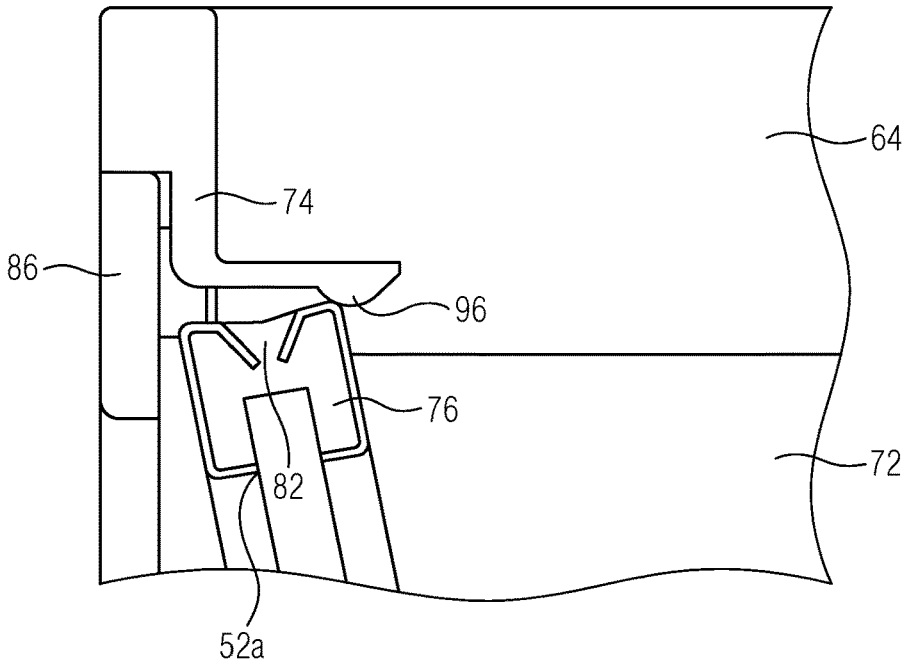
Figure 17:
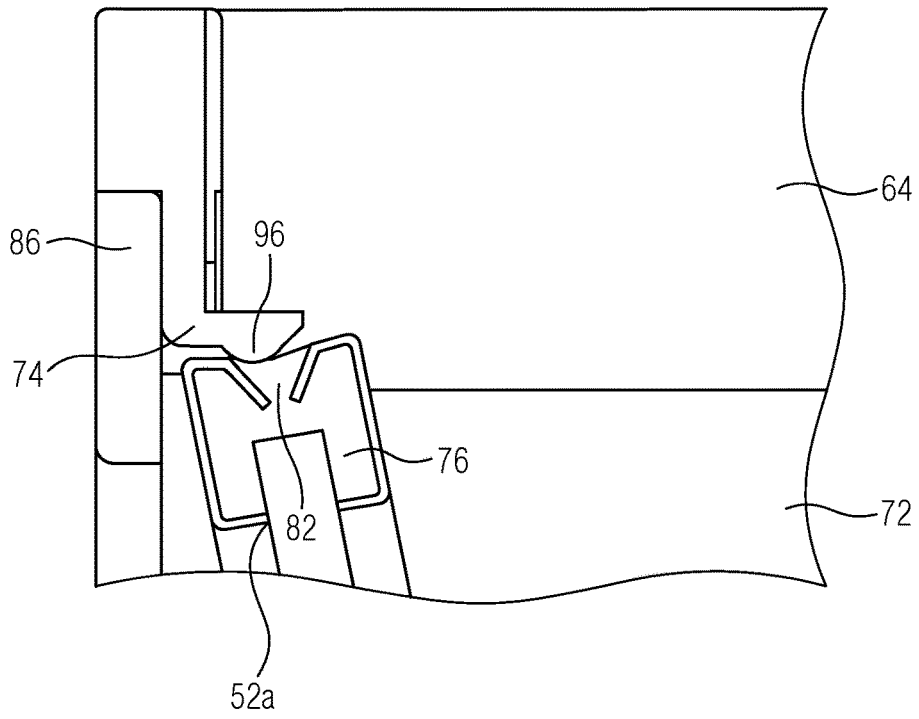

FIG. 16 is an enlarged detail view along the lines of FIGS. 9 and 11, but illustrating a third example of a retainer element; and FIG. 17 is an enlarged detail view along the lines of FIGS. 9, 11 and 16, but illustrating a fourth example of a retainer element.

In all figures the same or equivalent part are marked with the same reference numbers.

Figure 1:
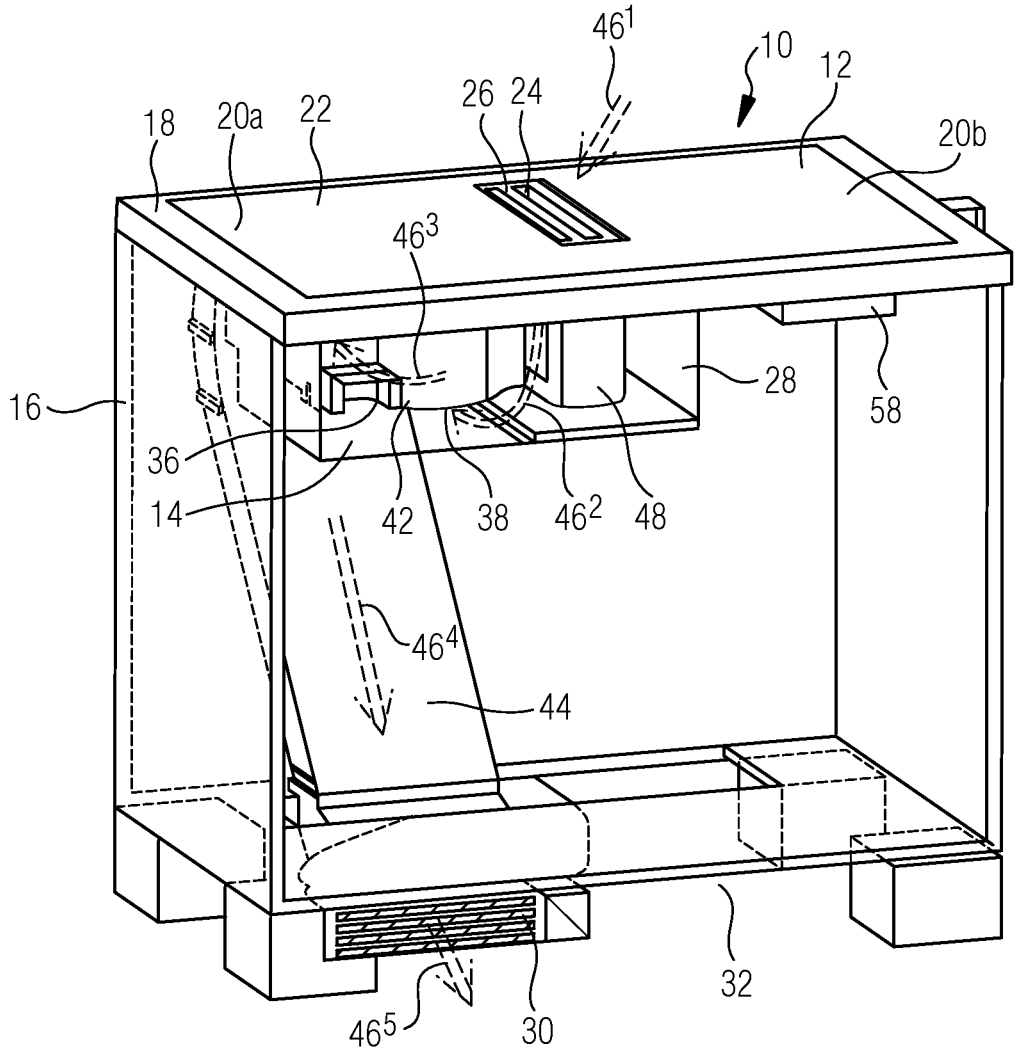

FIG. 1 illustrates a combination appliance 10 comprising a cooking hob 12 and a downdraft extraction device 14 installed in a kitchen cabinet 16. The cooking hob 12 is installed in a cut-out of a kitchen countertop 18 forming a top cover plate of the kitchen cabinet 16. The downdraft extraction device 14 is configured to take away cooking vapours occurring during cooking processes, in particular when cooking with uncovered cookware. As can best be seen in FIGS. 2 and 4, the cooking hob 12 comprises cooking regions 20*a*, 20*b* arranged on a left half and a right half of a worktop 22 of the cooking hob 12, which left and right halves are separated from each other by a suction opening 24 for an intake of the cooking vapours, the suction opening 24 being arranged alongside a worktop centreline. The suction opening 24 is covered by a cover grid 26 for preventing items, e.g. cookware, to fall into the suction opening 24.

A casing 28 of the extraction device 14 is shown in FIG. 1 in transparent illustration. Said casing 28 provides a closed outer shell or first channel for a flow of the sucked-in cooking vapours on their way from the suction opening 24 to an exhaust opening 30 in a base area 32 of the kitchen cabinet 16. Said exhaust opening 30 is also covered, namely by an outlet grille 34.

The flow of the sucked-in cooking vapours through the extraction device 14 is driven by the operation of an extraction fan 36 arranged inside of the casing 28. Said extraction fan 36 comprises a bottom-sided intake opening 38 for sucking the cooking vapours from the interior space of the casing 28.

Figure 3:
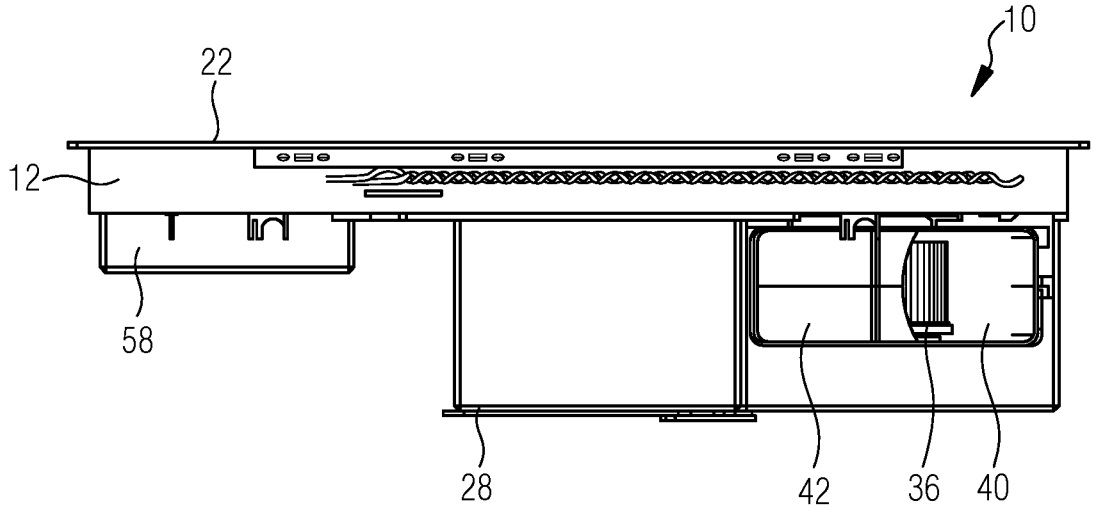
FIG. 3 is a rear view of the combination appliance of FIG. 2.

As illustrated by FIG. 3, which is a rear view of the combination appliance 10, a rear-sided fan outlet 40 is arranged for a horizontal exit of the air blown out backwards from the extraction fan housing 42. The fan outlet 40 is connected to a first end of an air duct 44 designed as a rectangular tube and forms a second channel arranged downstream the above-mentioned first channel. Directly at the passage from the fan outlet 40 to the air duct 44, an air duct bending by 90 degrees is implemented, which redirects the air flow from horizontal to vertical downwards. The air duct 44 may be guided alongside a rear side of the kitchen cabinet 16 and may be bent again by 90 degrees close to a rear lower edge of the kitchen cabinet 16 in order to direct the airflow towards exhaust opening 30 in the base area 32 of the kitchen cabinet 16. Accordingly, the second end of the air duct 44 is connected to the exhaust opening 30. The embodiment illustrated in FIG. 1 shows a solution of the air duct 44 with an inclined section of its downwardly directed portion, directed slightly to the right. Naturally, a solution with said portion arranged in an exact vertical direction is considerable as well.

The course of the cooking vapours from the cooking area through the extraction device 14 to a re-entry into room air is illustrated in FIG. 1 by dotted arrows $\mathbf{46}^1$ to $\mathbf{46}^5$. On their way through the extraction device 14, the cooking vapours pass through a filter assembly 48, which is arranged downstream directly behind the suction opening 24. Said filter assembly 48, which will be described in more detail further down below, includes a filter carrier 50 and a filter 52, in particular a grease filter, which is adapted to filter particles and droplets, in particular fat droplets, out of the cooking vapours, in that purifying the cooking vapours in order to feed filtered air back to the room air.

Figure 2:
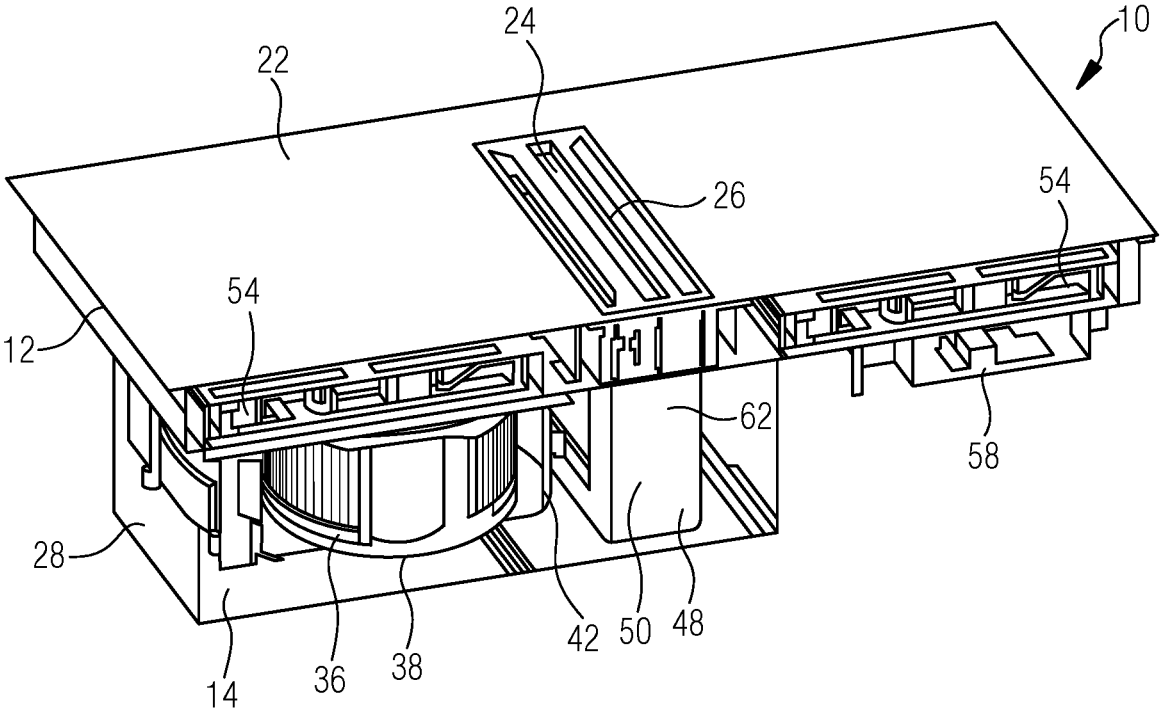
FIG. 2 is a cross-sectional perspective view of the disassembled combination appliance of FIG. 1 with a frontal surface cut away and including a first collection device and a first example of a second collection device for spilled liquids.

The cross-sectional view of FIG. 2 further shows two power boards 54, one for the left cooking region 20*a* and one for the right cooking region 20*b*, the power boards 54 providing cooking zones in the left and right cooking regions 20*a*, 20*b* with electrical power. In the present embodiment, the cooking hob 12 is an induction cooking hob and the cooking zones are defined by induction coils 56 (see particularly FIG. 4) that are arranged below the worktop 22 of the cooking hob 12. Attached to the bottom side of the power board 54 assigned to the right cooking region 20*b*, a further circuit board is arranged forming a control electronics for the combination appliance 10.

Figure 4:
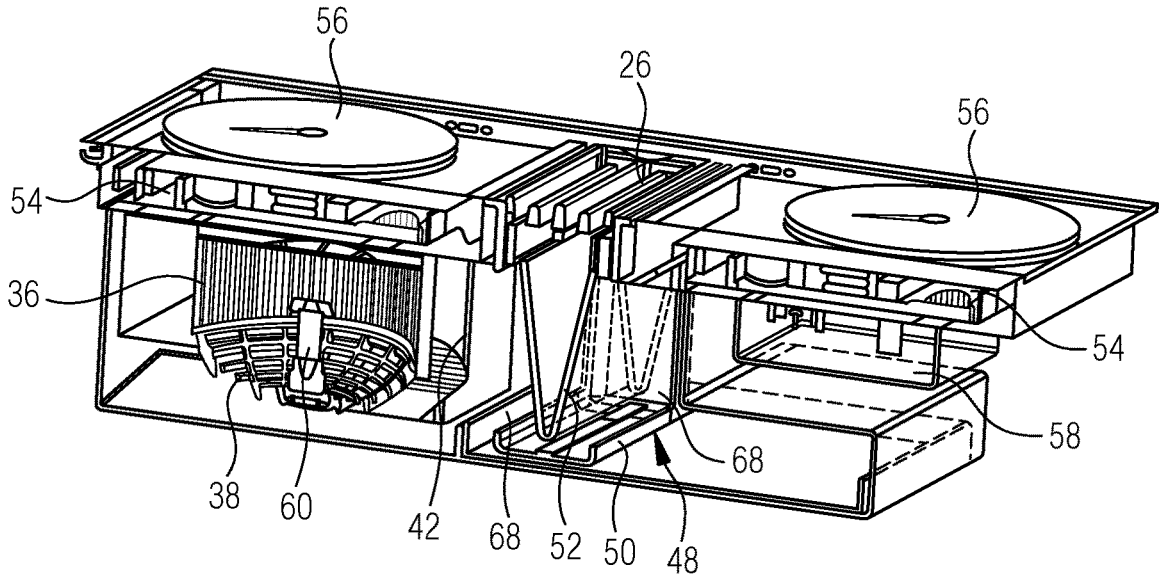
FIG. 4 is a combination appliance slightly different from that one of FIG. 2 with transparent worktop in a central cross-sectional view and from another perspective.

As can be seen from FIG. 4, which is also a cross-sectional illustration of the combination appliance 10, but with a section plane in a centre region (lengthwise related to the rectangular design of the cooking hob 12), the extraction fan 36 comprises a cylindrical fan propeller with a plurality of fan blades arranged along a cylinder shell surface, the fan propeller rotating around a vertical axis 60. In that, air is sucked in from below (intake opening 38) and blown out radially outwards, and leaving the fan housing 42 at the fan outlet 40, as already mentioned above. Further, a central cross-section through the filter assembly 48 is also provided by FIG. 4, which illustrates the arrangement of the filter 52 in the filter carrier 50.

Figure 5:
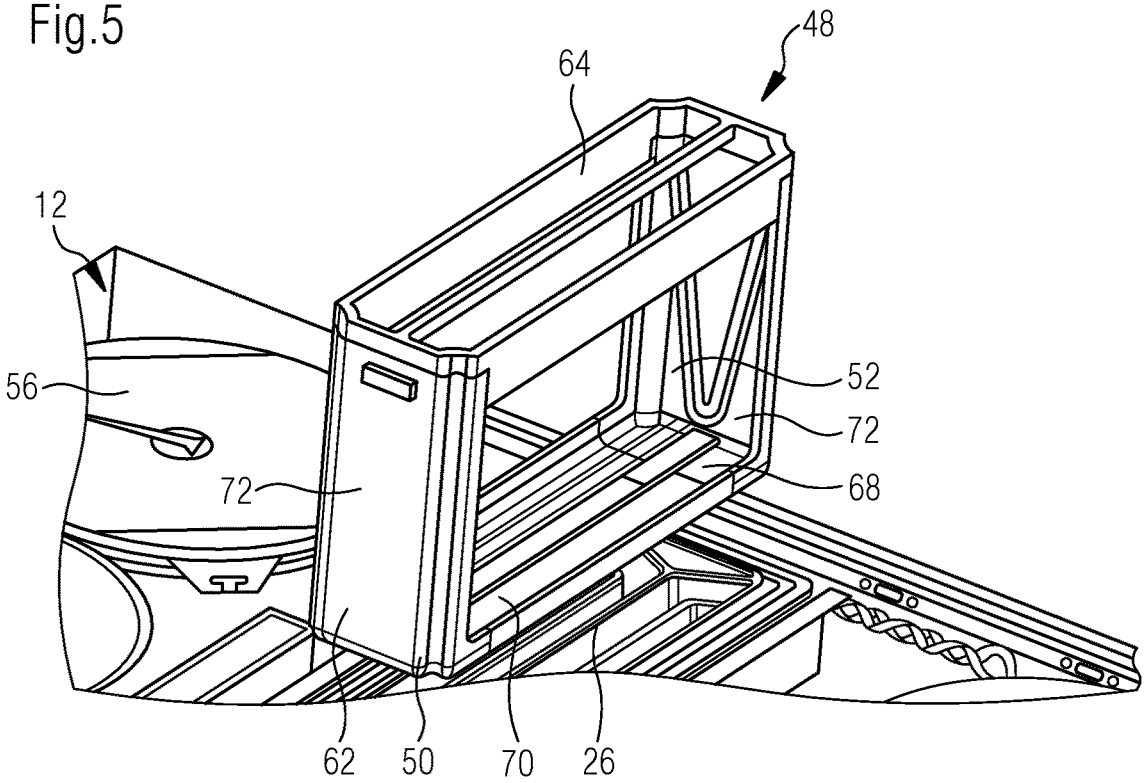
FIG. 5 is a filter carrier removed from the combination appliance of FIG. 4.

According to FIG. 5, the filter assembly 48 of FIG. 4 is removed from the suction opening 24 and illustrated in a raised position compared to the cooking hob 12. In order to remove the filter assembly 48, the cover grid 26 has to be removed prior to the removal of the filter assembly 48. This virtual state is not shown in the figures. Rather, according to FIG. 5, the cover grid 26 is illustrated in a position reinstated into the suction opening 24. The removed filter assembly 48, presented in FIG. 5 in its entirety and enlarged compared to FIG. 4, includes a V-shaped filter element 52 housed in the filter carrier 50 in a suspended position. The filter 52 of the embodiment according to FIGS. 4 and 5 is designed in one piece; i. e. the filter surface extends along the entire V-shaped area, including a rounded acute-angled bottom section thereof.

Figure 6:
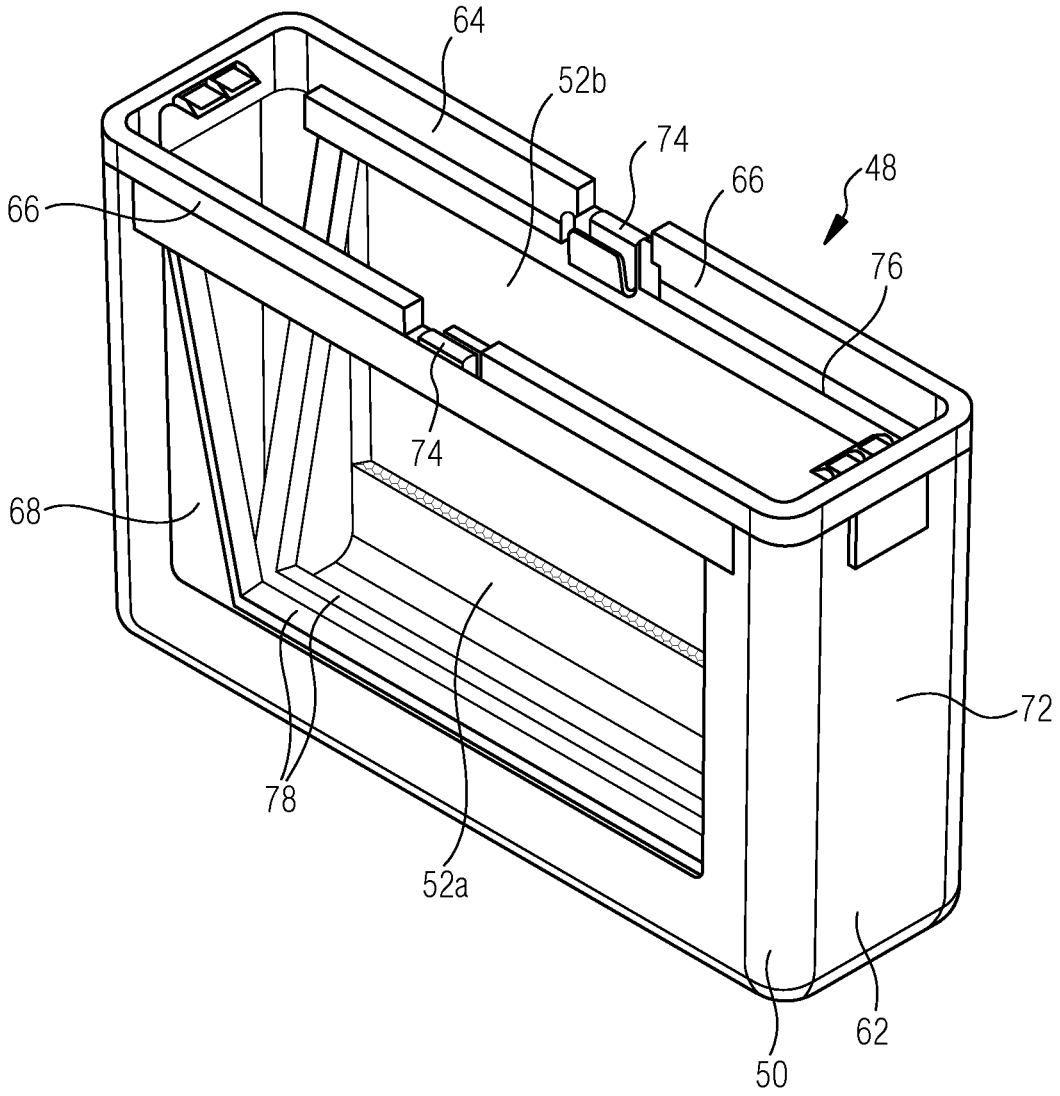
FIG. 6 is an individual depiction of a filter carrier similar to FIG. 5 with modified filter assembly and with a first example of a retainer element.
Figure 7:
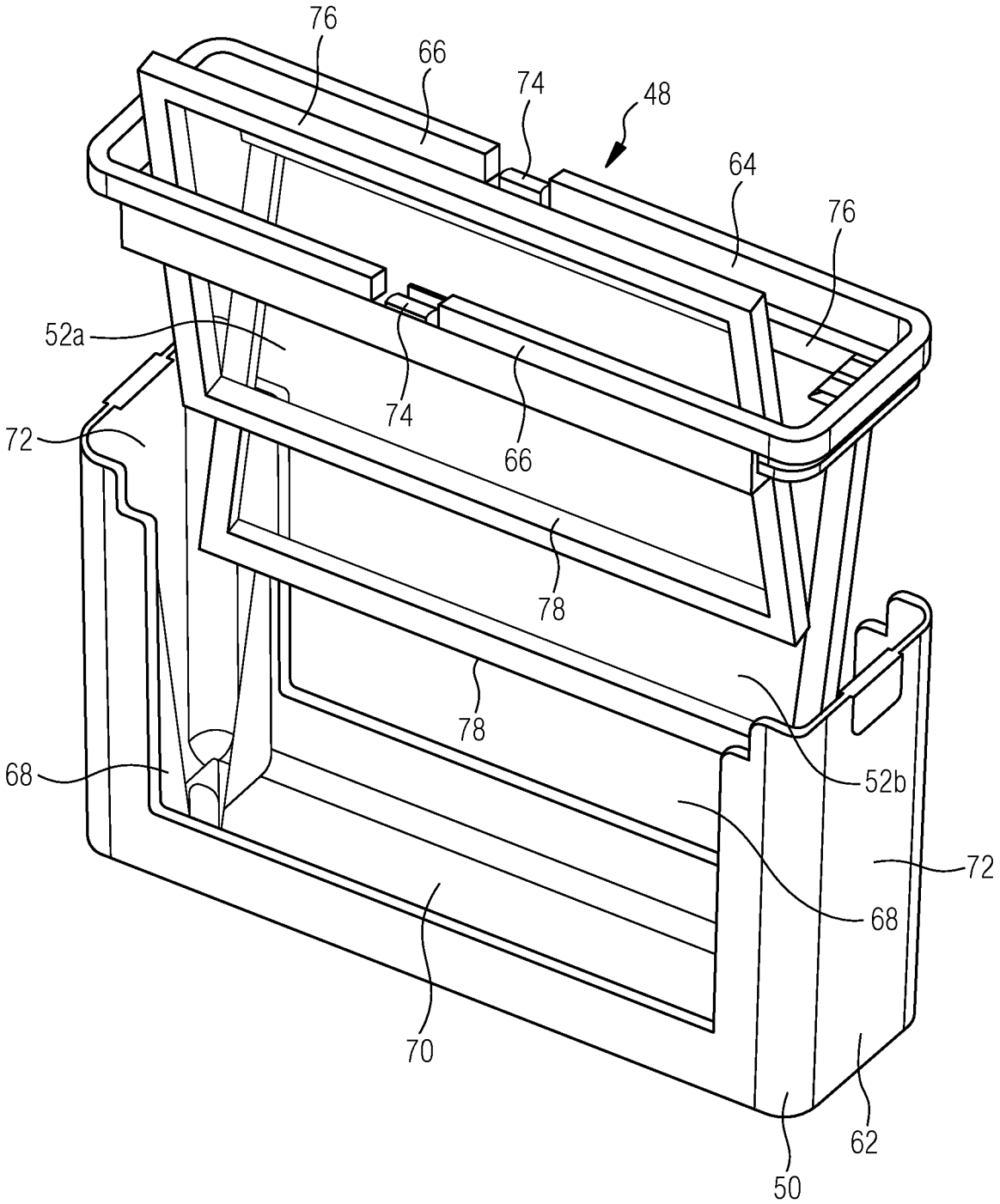
FIG. 7 is the filter assembly of FIG. 6 with lifted filter assembly.

Contrary to the above-described filter design according to FIGS. 4 and 5, the differently designed filter according to FIGS. 6 and 7 comprises two rectangular flat filter elements 52*a*, 52*b* arranged in inclined directions, in a way that, in the assembled state of the filter assembly 48 according to FIG. 6, they also form a V-shaped filter arrangement.

Both filter assembly embodiments, according to FIGS. 4, 5 and FIGS. 6, 7, are interchangeable, i. e. both solutions are equally suited for the combination appliance 10 according to the present invention.

As can be seen from FIG. 7 for the two rectangular flat filter elements 52*a*, 52*b*, but what is applicable also to the V-shaped filter element 52, not only the entire filter assembly 48 is removable from the suction opening 24, but also the filter 52, i. e. both the V-shaped filter 52 according to FIG. 5 and the two rectangular flat filter elements 52*a*, 52*b* according to FIGS. 6 and 7, are removable from the carrier housing 62, specifically for cleaning and/or replacing purposes.

FIG. 7 also shows the construction of the filter assembly 48 in more detail. As illustrated, the filter carrier 50 includes a carrier housing 62 and a carrier frame 64, which are separable from each other. In an assembled state, the carrier frame 64 forms an upper face of the filter carrier 50 and, in that, covers the open upper side of the carrier housing 62. Both types of filter arrangement, either the single-piece V-shaped filter 52 or the V-shaped arrangement of the two flat filter elements 52*a*, 52*b*, may be fixedly connected to the carrier frame 64. Preferably, however, as indicated by FIG. 7, either filter arrangement 52; 52*a*, 52*b* is disconnected from the carrier frame 64. In fact, the filter elements 52 or 52*a*, 52*b* and the carrier frame 64 are discontiguous units. Moreover, the carrier frame 64 are provided for keeping the flat filter elements 52*a*, 52*b* in place when the flat filter elements 52*a*, 52*b* are inserted in the carrier housing 62. To this end, two retainer elements 74 are included in the longer carrier frame parts 66, one thereof at each of these longer carrier frame parts 66, specifically in a centred arrangement. The retainer elements 74 and their functions are described in more detail further down below.

As shown in FIG. 2 by dotted arrows $\mathbf{46}^1$ and $\mathbf{46}^2$, the flow of cooking vapours is conducted from the suction opening 24 and the open top side of the V-shaped filter arrangement 52; 52*a*, 52*b* through the filter surface (mainly that one facing the extraction fan 36) before leaving the filter assembly 48 by penetrating the lateral surfaces 68 extending downwards from the longer carrier frame parts 66. In order to provide an extensive passage for the airflow on its way out from the carrier housing 62, the lateral surfaces 68 are open to a great extent, which results in remaining merely a frame section of each lateral surface 68.

An entire filtering of the cooking vapours, i. e. without providing any non-filtering bypass for the cooking vapours, is received by the two different filter arrangements 52; 52*a*, 52*b* in different ways:

The single-piece V-shaped filter 52 provides an all-round filter surface, of course not including its open top side, but, instead, including its end surfaces, so that an airflow in all horizontal directions penetrates a filter surface;

the V-shaped arrangement of the two flat filter elements 52*a*, 52*b* only provide a filtering passage through the filter surfaces of the flat filter elements 52*a*, 52*b*. In order to prevent any non-filtering bypass, the bottom edges of the rectangular flat filter elements are supported by the inner surface of the bottom area 70 in a way as to provide a mostly sealed contact area against that part of the carrier housing 62. Further, the end surfaces of this type of filter arrangement, which are lacking a filter surface, are also sealed against the carrier housing 62, e. g. by way of the lateral edges of the flat filter elements 52*a*, 52*b* abutting against the inner surfaces of end walls 72 of the carrier housing 62, also in a way as to provide a mostly sealed contact area against these parts of the carrier housing 62.

Both above-described filter designs are washable, e. g. in a dishwasher. Also the carrier housing 62 is washable after having been separated from the carrier frame 64.

Turning now to the specific arrangement of the flat filter elements 52*a*, 52*b* inside of the carrier housing 62 as well as the devices provided for keeping the flat filter elements 52*a*, 52*b* in their mounting positions. As indicated above, a retainer element 74 is assigned to each one of the two flat filter elements 52*a*, 52*b*. Each retainer element 74 is attached to, more specifically integrally formed at, the longer carrier frame part allocated thereto. As can be seen in more detail in FIG. 8, which is a perspective cross-sectional view with a centred section through filter carrier 50, flat filter elements 52*a*, 52*b* as well as both retainer elements 74, said retainer elements 74 are provided for holding down the related flat filter element 52*a*, 52, so that an upward movement is prevented. Each retainer element 74 acts on an upper cross member 76 of the rectangular frame of the flat filter element 52*a*, 52*b*. A lower cross member 78 of the flat filter element 52*a*, 52*b* rests on the bottom area 70 of the carrier housing 62. Due to the inclined arrangements of the both flat filter elements 52*a*, 52*b* because of the V-shape they are forming, a lateral support is included, which is not shown in detail in FIG. 8, but which may be realized by supporting bolts or ribs or by a supporting frame arranged in the bottom area 70 of the carrier housing 62. Alternatively, the lateral support for the lower cross member 78 of a first one 52*a* of the flat filter elements may merely be formed by the lower cross member 78 of a second one 52*b* of the flat filter elements, which lower cross members 78 support one another in horizontal direction.

Figure 8:
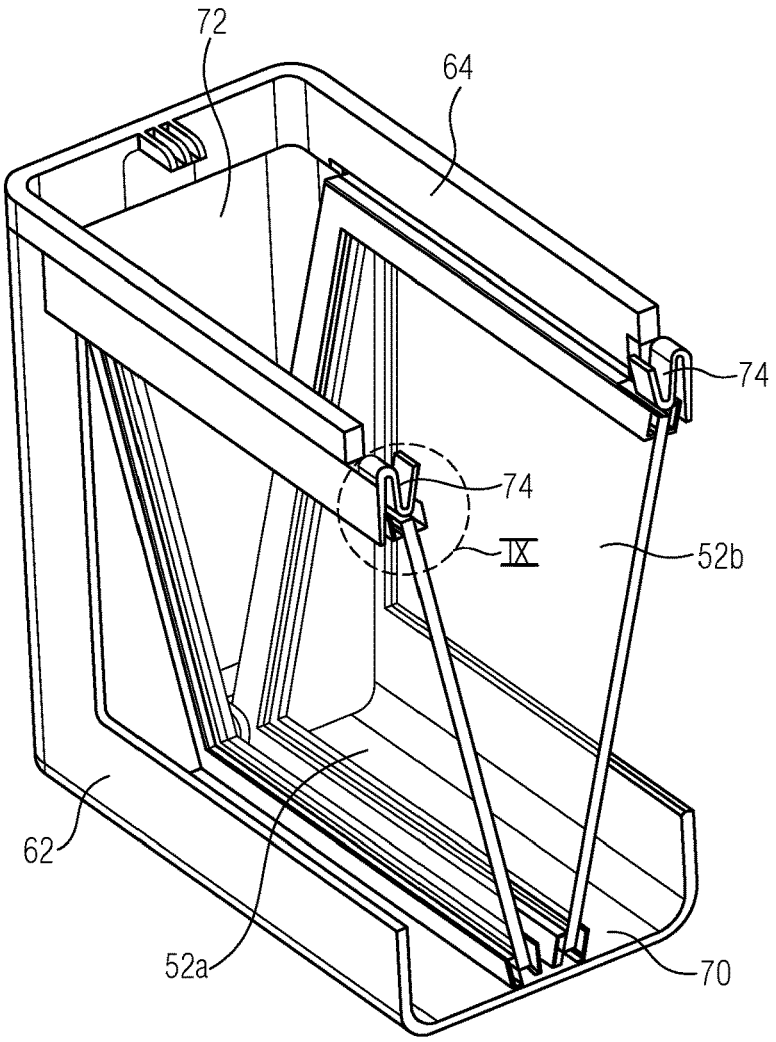
FIG. 8 is a perspective cross-sectional view of the filter assembly according to FIG. 6.

FIG. 9 is an enlarged view of the coupling between retainer element 74 and upper cross member 76 in lateral direction as indicated by detail IX in FIG. 8. As illustrated in this figure, the retainer element 74 is formed as an S-shaped structure (in cross-section and in reclining position) with a first end and an adjacent first curve being connected to the carrier frame 64 and with the second curve forming the actual downholder 80. Said downholder 80 engages with a recess 82 in the upper side of the upper cross member 76 of the filter frame, which recess 82 in the present example is also V-shaped. However, any other design for the recess may be considered as well, e. g. a trough-shape. In the mounting position according to FIG. 9, the retainer element 74 is slightly tensioned in order to provide a clamped mounting of the flat filter element 52*a*. The connection may be released for demounting the flat filter element 52*a* by raising the downholder 80 by acting on the free end of the S-shaped retainer element 74. FIG. 9 further illustrates a lead-in chamfer 84 at the second curve with orientation towards an approaching outer edge of the upper cross member 76 of the flat filter element 52*a* during a mounting process. Such lead-in chamfer allows an easier mounting process by enabling a sliding-in of said outer edge.

Figure 10:
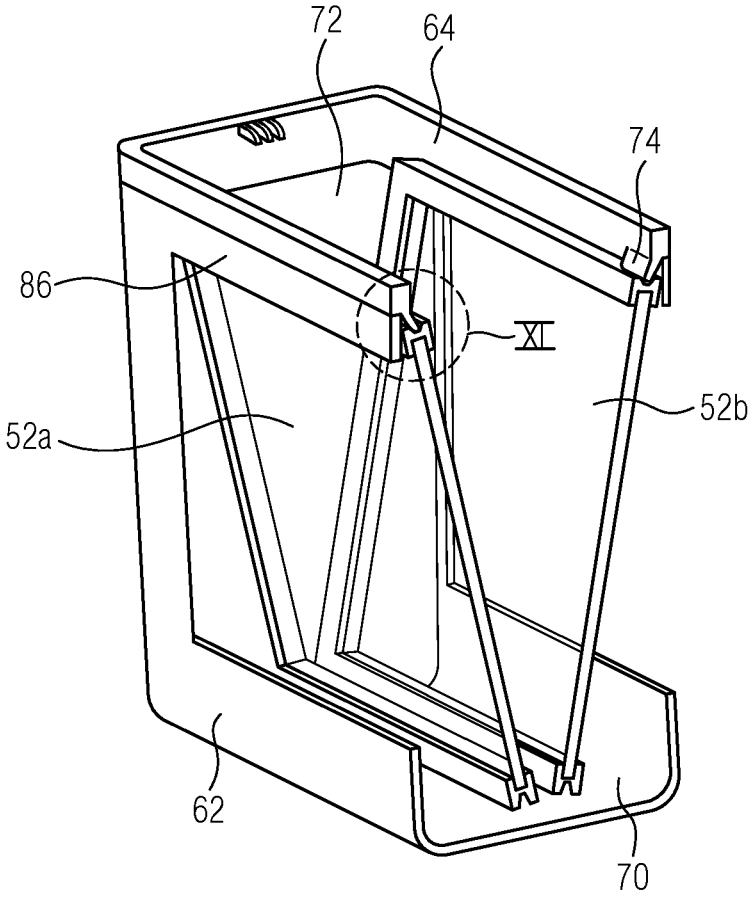
FIG. 10 is a perspective cross-sectional view of a filter assembly similar to FIG. 8, but with a second example of a retainer element.

The embodiment according to FIGS. 6 to 9 forms a first example for a retainer element 74 and related filter assembly according to the present invention. By FIGS. 10 and 11 a second example for a filter assembly is illustrated. This second example differs from the first example in some essential features. At first, as can be seen in the enlarged detail view of FIG. 11, which is an enlarged view of the coupling between retainer element 74 and upper cross member 76 in lateral direction as indicated by detail XI in FIG. 10, the retainer element 74 is formed in the second example as a stiff mandrel or tongue. Said mandrel or tongue is provided for an engagement in the recess 82, as it is also with the retainer element 74 according to FIGS. 6 to 9. The downholder 80 according to the second example is a rounded end portion of the mandrel or tongue. Due to the inflexibility of the retainer element 74 of the second example, also the mounting process is different to that one of the first example. This mounting process will be explained in more detail further down below with reference to FIGS. 13 to 15*b*. Moreover, contrary to the embodiment according to first example, the carrier housing according to FIGS. 8 and 9 comprises upper struts 86 between its end walls 72.

FIG. 12 presents an exploded view of the entire filter assembly, notably of all included components thereof, according to the second example. As already mentioned several times above, within the carrier housing 62 two flat filter elements 52*a*, 52*b* are arranged in V-shaped alignment. The carrier frame 64 closes the arrangement from above, by coupling it with the upper side of the carrier housing 62. The coupling, as an example, can be executed by a snapping mechanism. When closed by the carrier frame 64, the flat filter elements 52*a*, 52*b* are fixedly arranged in their respective mounting positions. FIG. 12 also illustrates the specific lower lateral support of the lower cross members 78 of the flat filter elements 52*a*, 52*b* according to the second example. To this end, close to the end walls 72 short vertical ribs 88 extend from the bottom area 70 upwards forming stops against lateral movement of the lower cross members 78 of the filter frames. Moreover, FIG. 12 also illustrates a left one of inclined guiding edges 90 allowing the side members of the filter frame to slide along during insertion of the flat filter elements 52*a*, 52*b*. Finally, the filter assembly according to the second example comprises four leaf spring elements 92, i. e. a left one and a right one for each flat filter element 52*a*, 52*b*, which provide a resilient support to the lower cross members of the filter frames, thereby pressing the filter frames of the flat filter elements 52*a*, 52*b* against the retainer elements 74.

Figure 13:
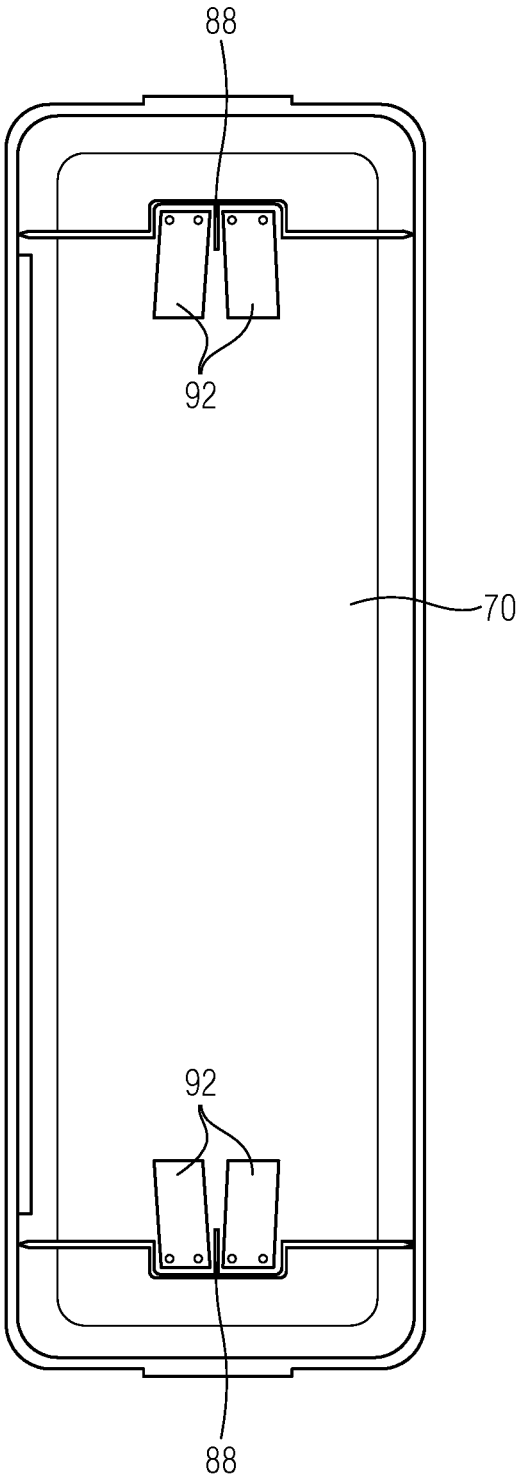
FIG. 13 is a top view of the bottom area of the unloaded carrier housing according to FIG. 12.

The mounting situation of the leaf spring elements 92 is more precisely shown by FIG. 13, which is a top view of the bottom area 70 of the unloaded carrier housing 62. Adjacent to the vertical ribs 88, to the left and right respectively, one leaf spring element 92 in each case is fixed at the bottom area 70 at one of its ends. Each leaf spring element 92 is fixed with an inclined orientation, in an unstressed state thereof, towards its other end, which is a free end of said leaf spring element 92 and which touches the bottom side of the related lower cross member 78.

Turning now to the specific mounting process of the flat filter elements 52*a*, 52*b* according to the second example, which will be explained with reference to FIGS. 14*a*, 14*b* and 15*a*, 15*b*. Following the illustration of FIG. 11, FIGS. 14*a* and 14*b* present the relation between retainer element 74 in two different situations during the mounting process, or demounting process respectively, of the flat filter element 52*a*, 52*b*. FIG. 14*a* shows the situation close to an end position of the retainer element 74 representing the mounting position of the flat filter element 52*a*, 52*b*, in which position the downholder section 80 of the retainer element 74 nearly entirely engages the recess 82 of the upper cross member 76 of the filter frame. In order to demount flat filter element 52*a* it has to be pushed further downward in order to release the retainer element 74 from its engagement with the recess 82, as is shown by FIG. 14*b*. In this situation, the flat filter element 52*a* can be turned inwards, so that the upper cross member 76 and, thereafter, the entire flat filter element 52*a* can move past the retainer element 74 when being lifted outside of the carrier housing 62.

Above-mentioned pushing further downward of the flat filter element 52*a* is performed against the force of the two leaf spring elements 92 related to flat filter element 52*a*, as is shown by FIGS. 15*a*, 15*b*, wherein the illustration of FIG. 15*a* corresponds to the mounting process situation of FIG. 14*a* and the illustration of FIG. 15*b* corresponds to the mounting process situation of FIG. 14*b*. Said FIGS. 15*a*, 15*b* illustrate a detail view of the lower cross member 78 of flat filter element 52*b* and one of the two related leaf spring elements 92 in the two mounting situations, wherein FIG. 15*a* shows the leaf spring element 92 in the situation of the flat filter element 52*b* being close to the end position, i. e. close to its final mounting position, and FIG. 15*b* shows the leaf spring element 92 in the situation of the flat filter element 52*b* being entirely pushed downwards for enabling the removal of the flat filter element 52*b* from the carrier housing 62. Moreover, FIGS. 15*a*, 15*b* in combination with FIG. 13 also disclose the fixation of each one of the leaf spring elements 92 at the bottom area 70 of the carrier housing 62 by means of two bolts 94.

FIGS. 16 and 17 disclose a third and a fourth example for the retainer element 74 and their respective retaining capacities for keeping the flat filter element 52*a* in place. Both third and fourth example operate with hook-shaped retainer elements 74, each of them including a bulge 96 positioned at a free end and directed downwards, wherein the third example according to FIG. 16 comprises a retainer element 74 with a long arm, therein forming a snapping hook, while the fourth example according to FIG. 17 comprises a retainer element 74 with a short arm, therein forming a mounting hook.

Due to its length, the snapping hook according to FIG. 16 reaches with its bulge 96 behind the inner top edge of the upper cross member 76, in that preventing both a turning movement and a lifting movement of the flat frame element 52*a*. Insofar, the recess 82 in the upper side of the upper cross member 76 is without function. The arm length also provides a flexibility of the snapping hook, so that an insertion of the flat filter element 52*a* may be realized in the same way as the first example, i. e. without any use of leaf spring elements. Naturally, using the same and providing a mounting process along the lines of the second example may even more facilitate the insertion process.

In contrast, the short arm solution according to fourth example illustrated in FIG. 17 is characterized by an engagement of the bulge 96 at the free end of the mounting hook with the recess 82 in the upper side of the upper cross member 76. Also in the fourth example the retaining element prevents both a turning movement and a lifting movement of the flat frame element 52*a*. The reduced arm length also goes hand in hand with a reduced flexibility, so that the mounting solution in line with the second example, i. e. using the leaf spring elements 92 for a pushing downwards of the flat filter element 52*a* in order to have the retainer element 74 disengaged from the recess 82 for the removal of the flat filter element 52*a*, is the only option.

Although illustrative embodiments of the present invention have been described herein with reference to the accompanying drawings, it is to be understood that the present invention is not limited to these precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 combination appliance
12 cooking hob
14 downdraft extraction device
16 kitchen cabinet
18 kitchen countertop
20*a*, 20*b* cooking regions
22 worktop
24 suction opening
26 cover grid
28 casing
28*a*, 28*b* first and second casing parts
30 exhaust opening
32 base area
34 outlet grille
36 extraction fan
38 intake opening
40 fan outlet
42 fan housing
44 air duct
46$^{1\ to\ 5}$ arrows indicating air flow
48 filter assembly
50 filter carrier
52 filter
52*a*, 52*b* flat filter elements
54 power boards
56 induction coil
58 control electronics
60 vertical axis
62 carrier housing
64 carrier frame
66 longer carrier frame part
68 lateral surface
70 bottom area
72 end wall
74 retainer element
76 upper cross member
78 lower cross member
80 downholder
82 recess
84 lead-in chamfer
86 upper strut
88 vertical rib
90 guiding edge
92 leaf spring element
94 bolt
96 bulge

The invention claimed is:

1. An extraction device for removing air comprising cooking vapours from an area above a cooking hob, the extraction device being configured to form a combination appliance in combination with the cooking hob, wherein the extraction device comprises:

an inlet opening for an intake of the air into an interior of the extraction device, an outlet opening for exhausting the air into ambient air, a first filter element comprising a filter area and a filter frame surrounding and supporting the filter area, a filter carrier for accommodating the first filter element, the filter carrier being removably arranged inside the extraction device, and a spring element supported against an inner surface of the filter carrier, wherein the first filter element and the filter carrier are arranged in an airflow direction between the inlet opening and the outlet opening, wherein the first filter element is a separate unit, which is separable and removable from the filter carrier, wherein the filter carrier comprises a first retainer element that extends from an upper portion of the filter carrier and engages an upper portion of the first filter element to retain the first filter element in the filter carrier, wherein the spring element acts on the first filter element by pressing the filter frame against the first retainer element, and wherein the filter frame comprises a first filter frame part or first filter frame section, which is assigned to the spring element, and a second filter frame part or second filter frame section, which is assigned to the first retainer element and which is opposite to the first filter frame part or first filter frame section, wherein at least one of the first and second filter frame parts or first and second filter frame sections comprises a recess or a cut-out for receiving a portion of the respectively assigned first retainer element or spring element.

2. The extraction device according to claim 1, wherein the first filter element is a flat filter element.

3. The extraction device according to claim 1, wherein the filter carrier comprises a filter seat for accommodating the first filter element, the first filter element being accommodated or accommodatable in a clamped position within the filter seat, the clamping being spring-loaded.

4. The extraction device according to claim 3, wherein the first retainer element is configured to retain the first filter element in the filter seat, the first retainer element:

being elastically arranged at the filter carrier, and/or being made of a flexible material, and/or forming a snapping or clamping element.

5. The extraction device according to claim 1, wherein the first retainer element and the spring element act on opposite sides of the filter frame.

6. The extraction device according to claim 1, wherein:

the filter frame is released or releasable from the first retainer element while the spring element is in a stressed state, and the spring element is at least partially unloaded when the filter frame is in its assembled position.

7. The extraction device according to claim 6, wherein the first retainer element is a part or portion of or is formed by a carrier frame part that is attachable or closable after putting the first filter element in place.

8. The extraction device according to claim 1, wherein the filter carrier comprises a carrier housing and a carrier frame part, which is completely removable from the carrier housing or rotatably mounted at an edge of the carrier housing, wherein the carrier frame part comprises the first retainer element.

9. The extraction device according to claim 1, wherein a filter seat of the filter carrier includes guiding means for a guided insertion of the first filter element and/or a support section for a pivoted take-up of the first filter element.

10. The extraction device according to claim 1, further comprising a second filter element that is separate from the first filter element such that the first and second filter elements are independently removable from the filter carrier, wherein the first filter element and the second filter element are arranged in the filter carrier and arranged in a V-shaped arrangement, and the filter carrier comprises a second retainer element that extends from the upper portion of the filter carrier and engages an upper portion of the second filter element to retain the second filter element in the filter carrier.

11. A combination appliance including a cooking hob and the extraction device according to claim 1.

12. A method for installing the first filter element in the filter carrier of the extraction device according to claim 1, comprising the steps of:

providing the extraction device of claim 1;

inserting the filter element in the filter carrier with a bottom edge thereof, and thereafter, pivoting the filter element into a mounting position within the filter carrier, said mounting position being an inclined mounting position.

13. The method according to claim 12, wherein in a consecutive order of the following installation steps the filter element is:

inserted in a lower section of a filter seat, pressed against a force of the spring element arranged in the lower section of the filter seat, pivoted into its mounting position, and supported against the first retainer element by at least partially releasing tension in the spring element.

14. A combination appliance comprising:

a cooking hob having a cover plate adapted to support cookware for cooking thereon and having an opening formed therein; and an extraction device arranged below the cover plate, the extraction device comprising:

a filter carrier arranged directly beneath said opening and comprising a carrier housing, a filter removably installed within the carrier housing, said filter being adapted to filter particulates and or droplets that pass through said opening in the cover plate, and to accommodate passage of air therethrough, a spring element supported against an inner surface of the filter carrier, and a fan configured to draw air from an area above the cover plate, through the opening therein, then through the filter and into an exhaust duct for recirculation of the drawn air back into a room space housing the combination appliance via an exhaust opening;

wherein said filter comprises a first filter portion having a first flat filter area and a first filter frame surrounding and supporting the first flat filter area;

wherein said filter carrier comprises a first filter seat adapted to accommodate the first filter portion in a definite first position when installed therein, and first clamping means adapted to reversibly clamp the first filter portion in said definite first position associated with the first filter seat in a manner that avoids noise cause by vibration of the first filter portion;

wherein said first clamping means of the filter carrier comprises a first retainer element that extends from an upper portion of the filter carrier and engages an upper portion of the first filter frame to retain the first filter element in the filter carrier; and wherein said spring element acts on the first filter portion by pressing the first filter frame against the first retainer element;

wherein said first retainer element extends from a first wall of the filter carrier, said first retainer element having a downholder or bulge facing downward that resiliently engages an upper cross member of the first filter frame, thereby fixing the first filter portion in said definite first position within the filter carrier; and wherein said downholder or bulge depends downwardly from a cantilevered portion of the first retainer element extending from said first wall of the upper part of the filter carrier, said cantilevered portion resiliently biasing the downholder or bulge into engagement with the upper cross member of the first filter frame.

15. The combination appliance according to claim 14, said downholder or bulge being resiliently biased into engagement with the upper cross member of the first filter frame via said spring element, wherein said spring element engages against a lower cross member of the first filter frame and urges the first filter frame upward in a direction toward the first retainer element.

16. The combination appliance according to claim 14, said filter further comprising a second filter portion having a second flat filter area and a second filter frame portion surrounding and supporting the second flat filter area;

said filter carrier further comprising a second filter seat adapted to accommodate the second filter portion in a definite second position when installed therein, and second clamping means adapted to reversibly clamp the second filter portion in said definite second position associated with the second filter seat in a manner that avoids noise cause by vibration of the second filter portion, the second clamping means comprising a second retainer element that extends from the upper portion of the filter carrier and engages an upper portion of the second filter portion to retain the second filter portion in the filter carrier;

said first and second filter portions being independent of one another and being independently removable from the filter carrier.

* * * * *